US012790902B2

(12) United States Patent
Gunasekaran et al.

(10) Patent No.: US 12,790,902 B2
(45) Date of Patent: Nov. 10, 2026

(54) FIELD REDRESSABLE SHEAR BLOCKER FOR FUZION TOOLS TO ELIMINATE THE SHEAR TO RELEASE CONTINGENCY

(71) Applicant: Halliburton Energy Services, Inc., Houston, TX (US)

(72) Inventors: Mohan Gunasekaran, Al-Khobar (SA); Ibrahim El Mallawany, Dhahran (SA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/035,412

(22) Filed: Jan. 23, 2025

(65) Prior Publication Data

US 2026/0210192 A1 Jul. 23, 2026

(51) Int. Cl.
*E21B 17/06* (2006.01)
*E21B 23/00* (2006.01)

(52) U.S. Cl.
CPC ..... *E21B 17/06* (2013.01); *E21B 23/00* (2013.01)

(58) Field of Classification Search
None
See application file for complete search history.

(56) References Cited

U.S. PATENT DOCUMENTS 6,196,325 B1 * 3/2001 Connell ..... E21B 17/041 166/242.6
10,704,339 B2 7/2020 El Mallawany et al.
11,111,738 B2 9/2021 El Mallawany et al.
2002/0000317 A1 1/2002 Rayssiguier et al.
2014/0202241 A1 7/2014 Angers, Jr. et al.
2019/0153788 A1 * 5/2019 El Mallawany ..... E21B 17/06
2022/0081993 A1 * 3/2022 Chevallier ..... E21B 34/10
2024/0011362 A1 1/2024 Silva

FOREIGN PATENT DOCUMENTS

WO 2022060384 A1 3/2022

OTHER PUBLICATIONS

International Search Report & Written Opinion; PCT Application No. PCT/US2025/016525; mailed Oct. 16, 2025.

* cited by examiner

*Primary Examiner* — Taras P Bemko
(74) *Attorney, Agent, or Firm* — NOVAK DRUCE CARROLL LLP

(57) ABSTRACT

Aspects of the subject technology relate to apparatus and methods for adapting mechanisms used to couple wellbore strings to wellbore tools. Such adaptations may include adding parts to a wellbore string such that forces used to withdraw a wellbore tool from a wellbore or move a wellbore tool in the wellbore may be modified. Such modifications may include adding a part that prevents relative motion between other parts of an attachment mechanism. Such a part may be referred to as a shear blocking element that prevents forces being transmitted to a shearable element. By placing the shearable element in a space of a connection mechanism of a wellbore sting may prevent the shearable element from breaking such that a wellbore tool may be removed from the wellbore more reliably.

20 Claims, 7 Drawing Sheets

FIELD REDRESSABLE SHEAR BLOCKER FOR FUZION TOOLS TO ELIMINATE THE SHEAR TO RELEASE CONTINGENCY

FIELD OF THE DISCLOSURE

The present disclosure relates to mechanisms used to selectively couple and decouple wellbore strings to wellbore tools. More specifically, the present disclosure is directed to modifying a connection mechanism to increase forces that may be applied to a wellbore string to remove a wellbore tool from a wellbore.

BACKGROUND

Wellbores are drilled into the Earth such that various substances can be extracted from or provided to underground subterranean strata. For example, wellbores are drilled such that oil, natural gas, brine, or water can be extracted. In some instances, materials such as hydraulic fracturing fluids or carbon dioxide are injected into subterranean strata either for the purpose of increasing yield from a well or for sequestering carbon dioxide underground. In order to perform such activities, tools are often deployed in a wellbore and retrieved from the wellbore.

BRIEF DESCRIPTION OF THE DRAWINGS

In order to describe the manner in which the features and advantages of this disclosure can be obtained, a more particular description is provided with reference to specific embodiments thereof which are illustrated in the appended drawings.

Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
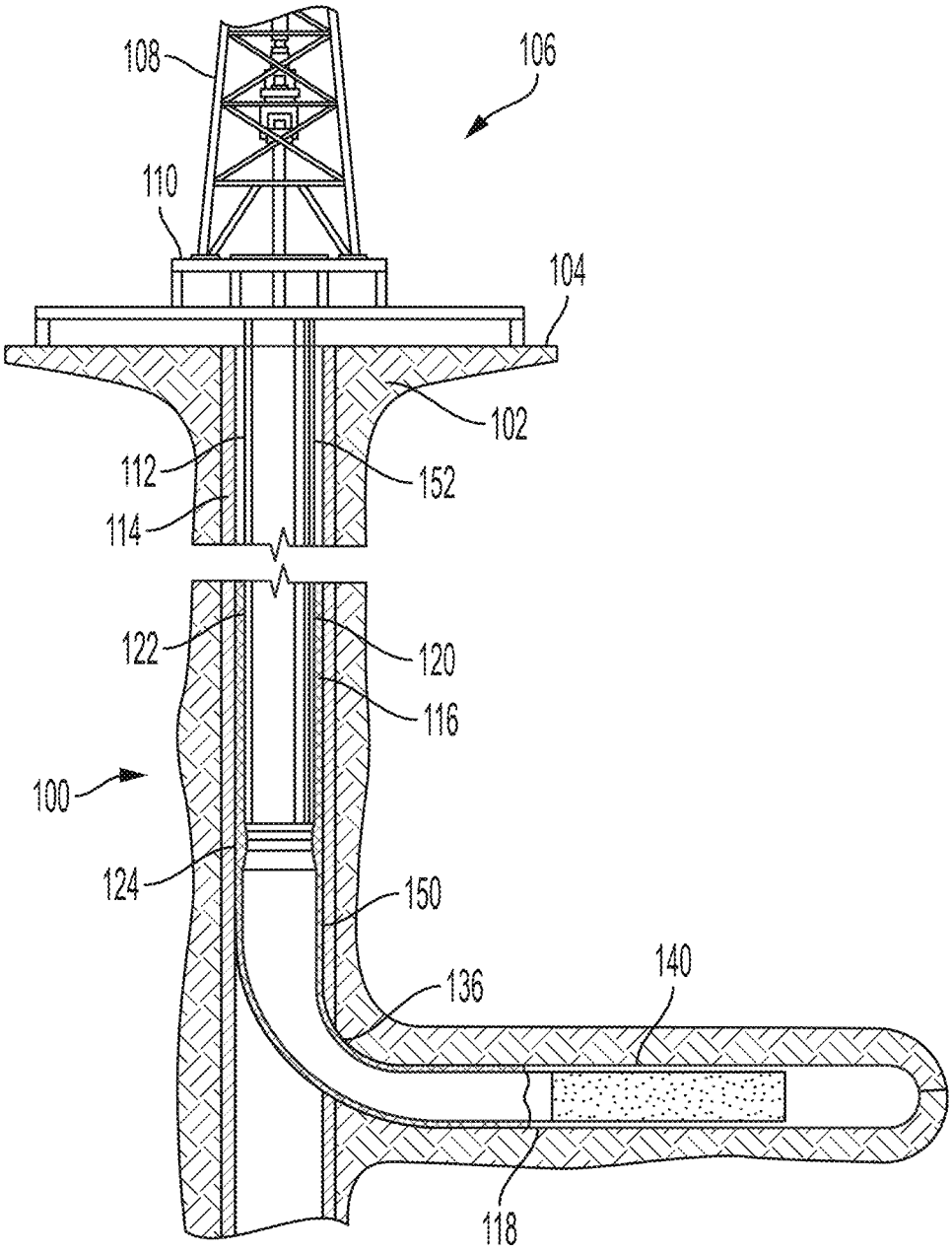
FIG. 1 illustrates an example of a wellbore operating environment where tools may be deployed when a wellbore is built or used, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Described herein are systems, apparatuses, processes (also referred to as methods), (collectively referred to as "systems and techniques") for adapting mechanisms used to couple wellbore strings to wellbore tools. Such adaptations may include adding parts to a wellbore string such that forces used to withdraw a wellbore tool from a wellbore or move a wellbore tool in the wellbore may be modified. Such modifications may include adding a part that prevents relative motion between other parts of an attachment mechanism. Such a part may be referred to as a shear blocking element that prevents forces being transmitted to a shearable element. By placing the shearable element in a space of a connection mechanism of a wellbore sting may prevent the shearable element from breaking such that a wellbore tool may be removed from the wellbore more reliably.

FIG. 1 illustrates an example of a wellbore operating environment where tools may be deployed when a wellbore is built or used. Drilling rig assembly 106 is illustrated as being positioned on surface 104 of the Earth. The environment 100 of FIG. 1 includes wellbore 114 that penetrates subterranean formation 102. Wellbore 114 may be built for the purpose of recovering hydrocarbons or sequestering materials like carbon dioxide. Furthermore, wellbore 114 may be drilled into subterranean formation 102 using any suitable drilling technique.

FIG. 1 shows that wellbore 114 proceeds vertically downward into subterranean formation 102 along wellbore portion 116. Wellbore 114 then curves to the right along wellbore portion 136 before proceeding in a direction that is parallel to the surface 104 along wellbore portion 118. Modern wellbores may extend in virtually any direction, they may initially follow one path and then curve in various directions as such, for example a wellbore may proceed vertically downward, turn to the left, turn to the right, and then proceed upward before turning downward again as the wellbore extends from a starting point to an end point. Wellbore 114 may include multiple portions, such as wellbore portions 116, 118, 122, 136, and 150.

Note that FIG. 1 shows tubular string 120 that is deployed within wellbore 114. In certain instances, tubular string 120 may be releasably coupled to a wellbore tool based on operation of a releasable connection mechanism. Tubing string 120 and associated tools may be lowered into a subterranean formation throughout the life of the wellbore for a variety of reasons. Such reasons may include yet are not limited to drilling the wellbore, servicing the wellbore, deploying production tubing, or collecting data regarding conditions of the wellbore. Data or control signals may pass via wires or fiber optic communication lines 152.

Tubular string 120 may be attached to drilling rig assembly 106 and derrick 108 before it is lowed into wellbore 114. Drilling rig assembly 106 may include a floor 110 through which tubular string 120 passes before extending downward into wellbore 114. Drilling rig assembly 106 may include a motor driven winch and/or other associated equipment for extending tubular string 120 into wellbore 114. Such a winch may be used to lower and position tubular string 120 within wellbore 114.

When tubular string 120 includes a releasable connection mechanism, that connection mechanism may be used to couple and decuple a portion of tubular string 120 to a wellbore tool. In certain instances, wellbore 114 may include casing 112 that is cemented in place. In other instances, wellbore 114 may be uncased or may include an uncased section. For example, uncased section 140 may include a section of the wellbore 114 that is ready to be cased. In other instances, uncased section 140 may be open when uncased section 140 is a zone where hydrocarbons are extracted from or where other materials (e.g. carbon dioxide or fracturing fluids) are injected. In any of these instances, tubular string 120 may include a connection mechanism used to couple tubular string 120 to a tool. For example, tubular string 120 may connect to a tool at location 124 of FIG. 1.

Figure 2A:
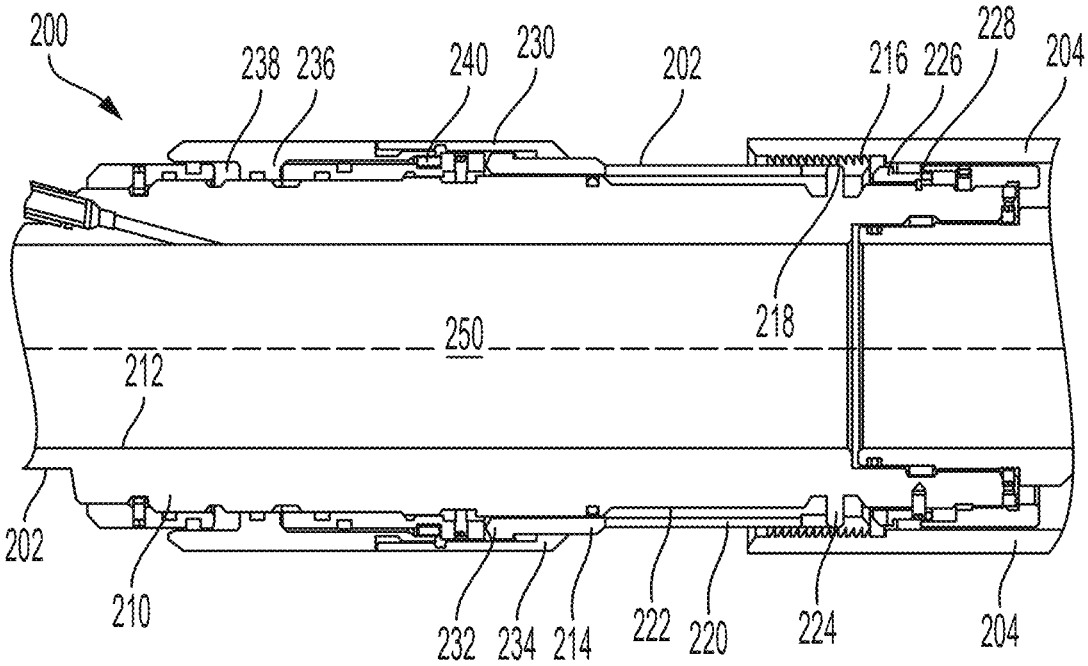
FIGS. 2A and 2B illustrates cross-sectional views of a releasable connection assembly that may be used to connect a wellbore string to a wellbore tool, in accordance with aspects of the present disclosure.
Figure 2B:
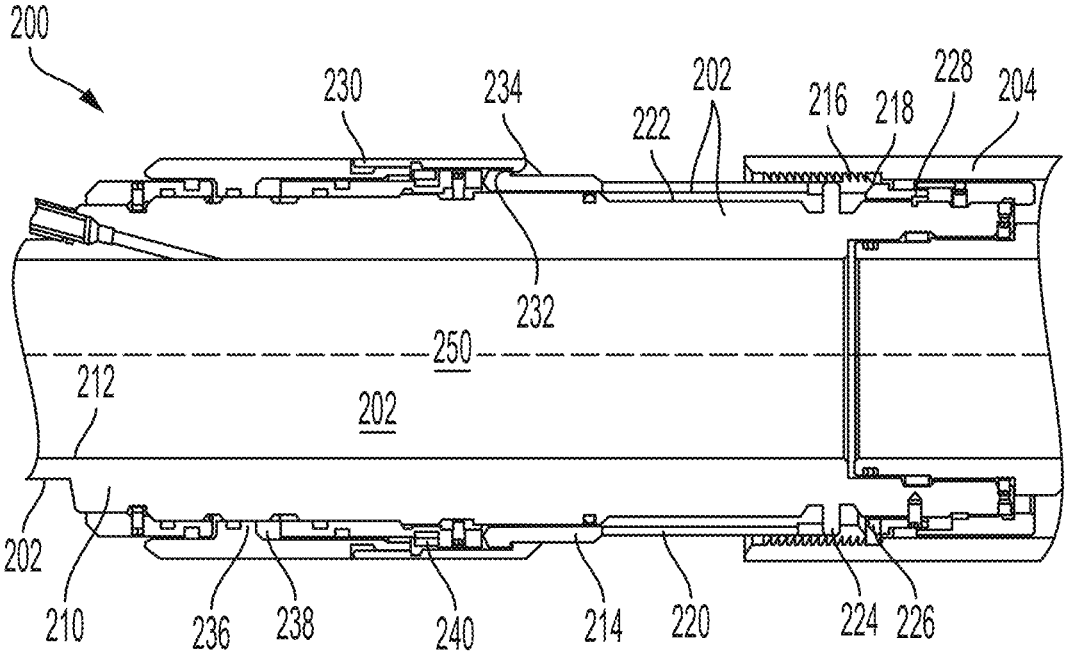

FIGS. 2A and 2B illustrate cross-sectional views of a releasable connection assembly that may be used to connect a wellbore string to a wellbore tool. Such a wellbore string may include or be attached to the tubular string 120 of FIG. 1. Releasable connection mechanisms of the present disclosure may be used in any type of wellbore tubular string or tubular member configuration. Examples of tubular strings include a set of production tubing or coiled tubing of image. Assembly 200 of FIG. 2A includes various parts that allow a wellbore string to be coupled to and decoupled from a downhole tool or other apparatus. Releasable connection mechanisms of the present disclosure, such as assembly 200 of FIGS. 2A and 2B, may be used to provide a hydraulic pathway for various other downhole components (e.g., various downhole subs, pumps, and/or servicing tools) once a connection is formed. For example, a wellbore tubular string may include upper running tool portion of wellbore string 202 that is conveyed into a wellbore to engage an end portion of downhole tool 204. Such a connection may be used to establish one or more pathways (e.g., paths for hydraulic fluid) through a releasable connection mechanism. Here running wellbore string 202 may have a protrusion that fits inside of the end portion of downhole tool 204. Here the protrusion of running tool portion of wellbore string 202 and the end portion of downhole tool 204 may each be threaded. In certain instances, wellbore string 202 may be referred to as upper portion of a wellbore tool and downhole tool 204 may be referred to as a lower portion of that wellbore tool.

Regardless of the type of operational environment in which tubular string 120 with a releasable connection mechanism is used, it will be appreciated that such a releasable connection mechanism may serve to provide a releasable connection with other tubular members, downhole tools, or assemblies within wellbore 114. Further, the releasable connection mechanism of FIGS. 2A & 2B may allow for one or more hydraulic, electric, or fiber optic pathways to be established between wellbore string 202 and downhole tool 204.

FIG. 2A shows a releasable connection mechanism in a disengaged position. FIG. 2B shows the releasable connection mechanism in the engaged position. Further, though this description generally refers to the releasable connection mechanism engaging with the downhole tool 204, the present disclosure is not so limited, as the releasable connection mechanism may be used to connect and disconnect (e.g., anchor or release) with other components (e.g., a tubular member, a downhole assembly, etc.). The terms "downhole tool" or "wellbore tool" may be used to refer to a tool, a tubular member, or an assembly that is deployed in a wellbore.

Assembly 200 is generally defined about an axis (e.g., a center line 250 of a wellbore string/tubular) and includes mandrel 210 with a flow passage 212 formed through the mandrel 210. Collet 214 is carried on the mechanism and is positioned about mandrel 210. Collet 214 includes collet engagement surface 216 that may be used to engage and mate with a corresponding downhole tool engagement surface 218 of downhole tool 204. Engagement surfaces 216 and 218 may be a ratchet-latch type of engagement, as shown. Thus, one of engagement surfaces 216 and 218 may include teeth (e.g., the collet engagement surface 216 in this embodiment), and the other one of engagement surfaces 216 and 218 may include corresponding teeth or a threaded surface (e.g., the downhole tool engagement surface 218 in this embodiment). Further, collet 214 is shown at least partially positioned within downhole tool 204. The collet engagement surface 216 may be formed on an outer surface at an end of the collet 214, and the downhole tool engagement surface 218 may be formed on an inner surface at an end of the downhole tool 204.

Collet 214 may be radially flexible (e.g., radially compressible and/or expandable) with respect to mandrel 210 or downhole tool 204, for engagement surfaces 216 and 218 to engage and disengage with each other. For example, collet 214 includes a plurality of slots that may define a plurality of collet fingers 220 that flex or bend with respect to downhole tool 204 or with respect to mandrel 210 when a wellbore string is coupled to a wellbore tool. Further, recess 222 may be formed between collet 214 and the mandrel 210, such as by having recess 222 formed on an outer surface of mandrel 210. This may enable collet 214 to deflect and bend radially inward into recess 222 when flexing.

Collet 214 may be able to move parallel with respect to mandrel 210 or a center line 250 of a wellbore string. Further, though not necessary, collet 214 may be rotationally constrained with respect to mandrel 210 such that collet 214 is not able to rotate about or with respect to mandrel 210. For example, as shown, mandrel 210 may include one or more tabs 224 that protrude into or through the slots of collet 214 and between collet fingers 220, preventing rotation but enabling axial movement between collet 214 and mandrel 210.

Assembly 200 includes ring housing 226. Ring housing 226 may be positioned about mandrel 210. This connection mechanism may include element 228 that shears (or breaks) when a selected force is applied to that element. Such a shearable element may be in the form of a ring and as such this shearable element maybe referred to as a "shear ring," a "shearable element," or a "shearable device." For purposes of this disclosure, element 228 will be referred to as "shear ring 228". FIGS. 2A and 2B include shear ring 228 that may be positioned between mandrel 210 and ring housing 226. Shear ring 228 may prevent axial movement between mandrel 210 and ring housing 226 (e.g., movement parallel to a center line 250 of wellbore string 202). Shear ring 228 may be designed to shear when a predetermined amount of force is applied to shear ring 228.

When shear ring 228 breaks or shears, the ring housing 226 may be allowed to move axially with respect to the mandrel 210.

Assembly 200 further includes collet stop 230 positioned about mandrel 210 and at least partially about an end of collet 214. Collet stop 230 may be axially movable with respect to mandrel 210 and collet 214, such as between a disengaged position and an engaged position. FIG. 2A shows collet stop 230 in the disengaged position with respect to collet 214, and FIG. 2B shows collet stop 230 in the engaged position with respect to collet 214. Here, collet 214 includes collet shoulder 232, and collet stop 230 includes a corresponding shoulder 234. In the disengaged position, collet stop 230 may contact while not engaging collet 214. For example, in the disengaged position, even though collet stop 230 may engage the collet 214 (e.g., slidingly engage), collet stop 230 and collet 214 are axially movable with respect to each other, and further collet 214 is axially movable with respect to mandrel 210. In the engaged position, collet stop 230 engages and contacts collet 214 to prevent axial movement between collet stop 230 and collet 214, and to prevent axial movement between collet 214 and mandrel 210. In particular, in the engaged position, collet stop shoulder 234 engages and contacts collet shoulder 232 to prevent axial movement of collet 214 and collet stop 230 with respect to each other.

In one or more instances, collet stop 230 may be mechanically actuated, hydraulically actuated, pneumatically actuated, and/or electrically actuated. Actuation may move collet stop 230 with respect the collet 214 and/or mandrel 210. For example, collet stop 230 may be hydraulically actuated to move with respect to collet 214 and mandrel 210. In this embodiment, piston 236 may be positioned within chamber 238 formed about mandrel 210 with piston 236 coupled to collet stop 230. Pressurized fluid may be provided to one side (e.g., downstream side) of the piston 236 to move the collet stop 230 from the disengaged position to the engaged position, and may be provided to the other side (e.g., upstream side) of piston 236 to move collet stop 230 from the engaged position to the disengaged position.

As mentioned above, assembly 200 may be used to selectively disconnect a tubular (e.g., wellbore sting 202) from the downhole tool 204. A releasable connection mechanism may be used to connect a tubular (e.g., wellbore sting 202) to the downhole tool 204 through the engagement of the engagement surfaces 216 and 218. FIG. 2A shows collet stop 230 in disengaged position with respect to the collet 214. Tension, for instance, may be applied between running wellbore string 202 and downhole tool 204, such as when the downhole tool 204 is deployed in a wellbore. When tension is applied, collet 214 may be axially stationary with respect to downhole tool 204. At this time, mandrel 210 and ring housing 226 may move axially with respect to collet 214 and downhole tool 204. For example, a gap previously defined or formed between collet 214 and ring housing 226 may allow collet 214 to engage and contact the ring housing 226. An increase compression may force engagement surfaces 216 and 218 against each other. In some instances, a tapered or angled end surface of collet 214 contacts a corresponding tapered or angled end surface of ring housing 226. This engagement between collet 214 and ring housing 226 may prevent collet engagement surface 216 from disengaging the downhole tool engagement surface 218. Further, this engagement may prevent the releasable connection assembly from disconnecting from downhole tool 204. This may occur even when tension is applied to running wellbore string 202 with respect to the downhole tool 204, such as when deploying or moving the downhole tool 204. Thus, when collet stop 230 is in the disengaged position with respect to collet 214 and tension is applied, collet 214 may engage ring housing 226, thereby preventing collet engagement surface 216 from disengaging downhole tool engagement surface 218. This may prevent wellbore string 202 from disconnecting from the downhole tool 204.

When collet stop 230 is in the disengaged position and tension is applied between running wellbore string 202 and the downhole tool 204, the ring housing 226 may be able to prevent collet engagement surface 216 from disengaging the downhole tool engagement surface 218. However, in one or more instances, when enough tension (e.g., above a predetermined amount) is applied, the collet engagement surface 216 may be able to disengage from the downhole tool engagement surface 218 to enable wellbore string 202 to disconnect from the downhole tool 204. For example, when ring housing 226 is connected to mandrel 210 through shear ring 228, once a selected amount of shear force is experienced by the shear ring 228, the shear ring 228 may shear (or break). The breaking of shear ring 228 may allow ring housing 226 to move with respect to mandrel 210. This arrangement prevents ring housing 226 from engaging collet 214, and thus collet engagement surface 216 can disengage from downhole tool engagement surface 218. As such, a releasable connection assembly 200 may allow downhole tool 204 to be disconnected from running wellbore string 202.

In some instances, collet stop 230 may be able to be locked in the engaged position to prevent movement of collet stop 230 towards the disengaged position. For example, snap ring 240 may engage with collet stop 230 or a component coupled to collet stop 230 to lock collet stop 230 in the engaged position. FIG. 2A shows snap ring 240 in a collapsed position that may enable movement of collet stop 230 with respect to mandrel 210 and collet 214. Once collet stop 230 moves to the engaged position, shown in FIG. 2B, snap ring 240 may expand to engage the collet stop 230. Once the snap ring 240 is in the expanded position, collet stop 230 may be locked in the engaged position to prevent movement of collet stop 230 back towards the disengaged position.

In operation a wellbore string may be lowered into a wellbore. This wellbore string may include parts of a mechanism that allows the wellbore string to be releasably coupled to a tool deployed in the wellbore. In certain instances, once the coupling parts of the wellbore string are in position relative to coupling parts of the wellbore tool, an actuator (e.g., a hydraulic actuator) may be actuated to couple the wellbore string to the wellbore tool. In other instances, relative motion between a wellbore string and a wellbore tool may force actuation of a coupling mechanism. As mentioned above, such a coupling, once made may allow fluids to flow between the wellbore string and the wellbore tool via tubes of the wellbore string. Sometime later, the coupling parts that attach the wellbore string to the wellbore tool may be released such that the wellbore string may be separated from the wellbore tool by applying tension to the wellbore string.

In certain instances, the tension applied to the wellbore string may result in a force being applied to shear ring 228 that is sufficient to break shear ring 228. This may occur when a force holding the wellbore string in place exceeds forces transmitted to the shear ring. Here again the shear ring may break when it is exposed to a selected force.

Apparatus consistent with the present disclosure may be configured to include a space within which a shear blocking element may be placed. When the shear blocking element is not placed within this space and when a releasable connection mechanism used to releasably connect the wellbore sting to a wellbore tool is in the release position, tension is applied to a wellbore string may result in force being applied to a shear ring (such as shear ring 228 of FIGS. 2A & 2B). When the force applied to the shear ring reaches sufficient force to break the shear ring, the shear ring will break as discussed above. As such, when the shear blocking element is not placed within a space configured to receive that shear blocking element, a portion of a tension force applied to a wellbore sting may be transferred to the shearable element.

Alternatively, when a shear blocking element is placed in the space mentioned above, the shear blocking element may prevent forces from being transferred to the shear ring. In such an instance, the shear ring will not break because the shear blocking element prevents force from being applied to the shear ring. As such, tension may be applied to the drill string that would otherwise result in breakage of the shear ring.

Figure 3A:
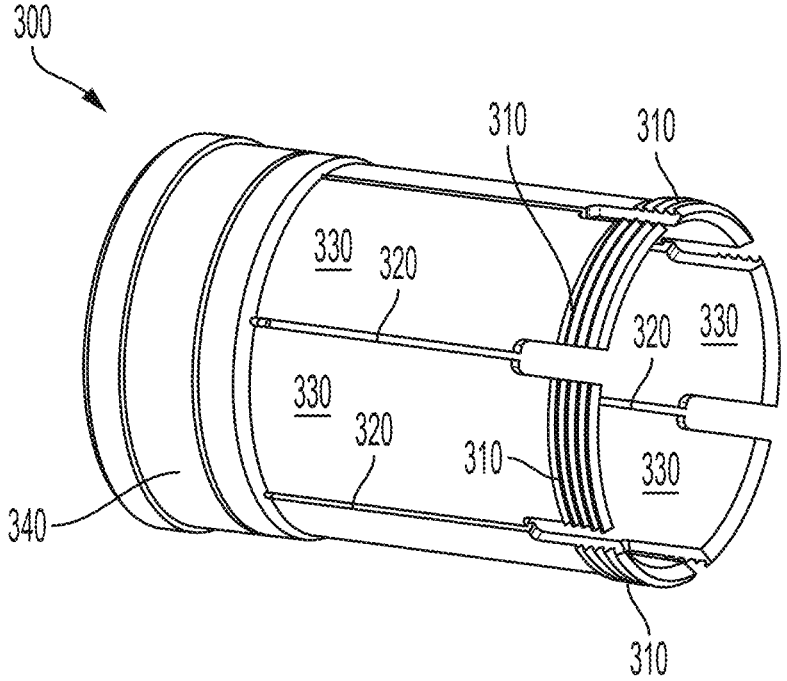
FIG. 3A illustrates a collet that may be used in a releasable connection mechanism, in accordance with aspects of the present disclosure.

FIG. 3A illustrates a collet that may be used in a releasable connection mechanism. Collet 300 of FIG. 3A may be the same as collet 214 of FIGS. 2A & 2B.

Collet 300 includes threads 310 located on one end and includes a second end 340 that connects to a lower end of a wellbore string. Collet 300 may include fingers 330 formed based on the presence of slots 320 in portions of collet 300. By including slots, the end of the collet where threads 310 are located may flex when a lower end of a wellbore string is pressed into a compatible portion of a wellbore tool.

Figure 3B:
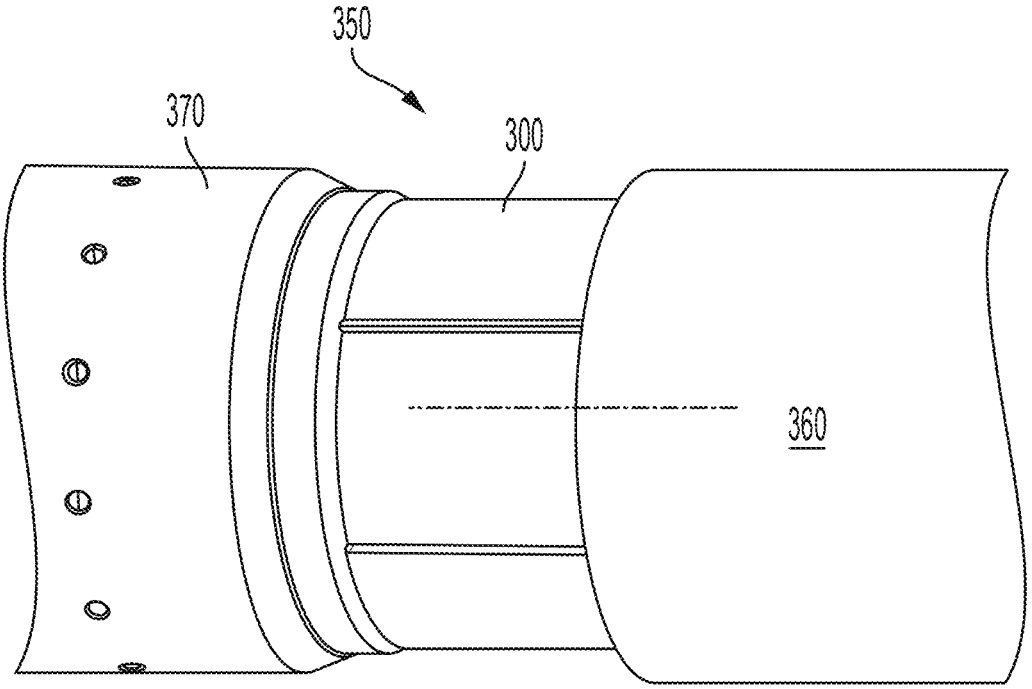
FIG. 3B illustrates the collet of FIG. 3A that is used to help couple a lower end of a wellbore string to a wellbore tool, in accordance with aspects of the present disclosure

FIG. 3B illustrates collet 300 of FIG. 3A that is used to help couple a lower end of wellbore string 370 to wellbore tool 360. In an instance when wellbore tool 360 is deployed in a wellbore and when wellbore string is lowered into the wellbore, collet 300 may be attached to the lower end of wellbore string 370. In operation, the flexibility provided by wellbore string 370 may allow wellbore string 370 to be coupled to wellbore tool 360 more easily as shown in image 350 of FIG. 3A.

Figure 4A:
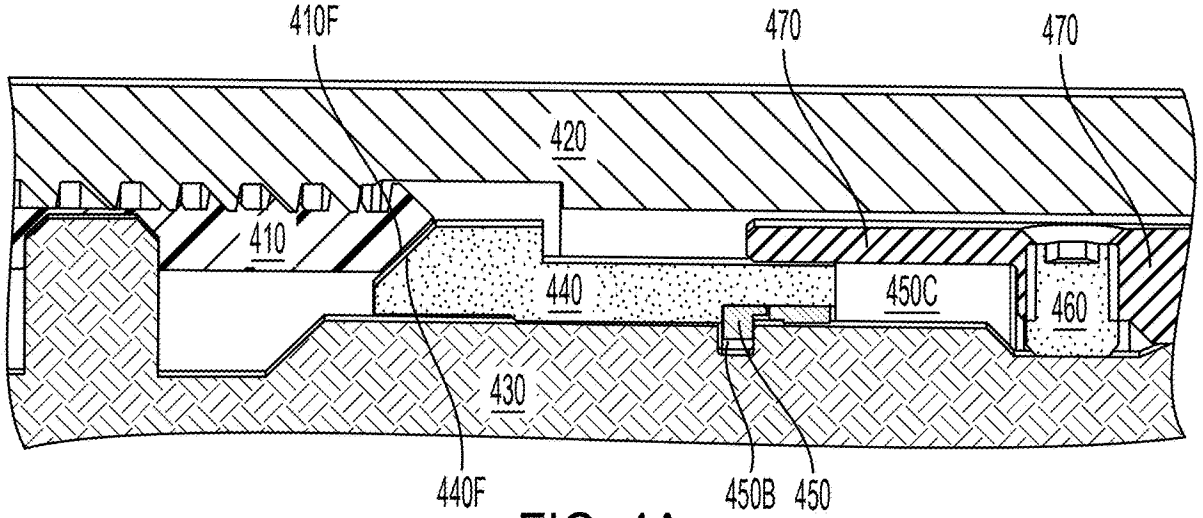
FIGS. 4A and 4B illustrate cross-sectional views of parts of a lower end of a wellbore sting that attach to an upper end portion of a wellbore tool, in accordance with aspects of the present disclosure.
Figure 4B:
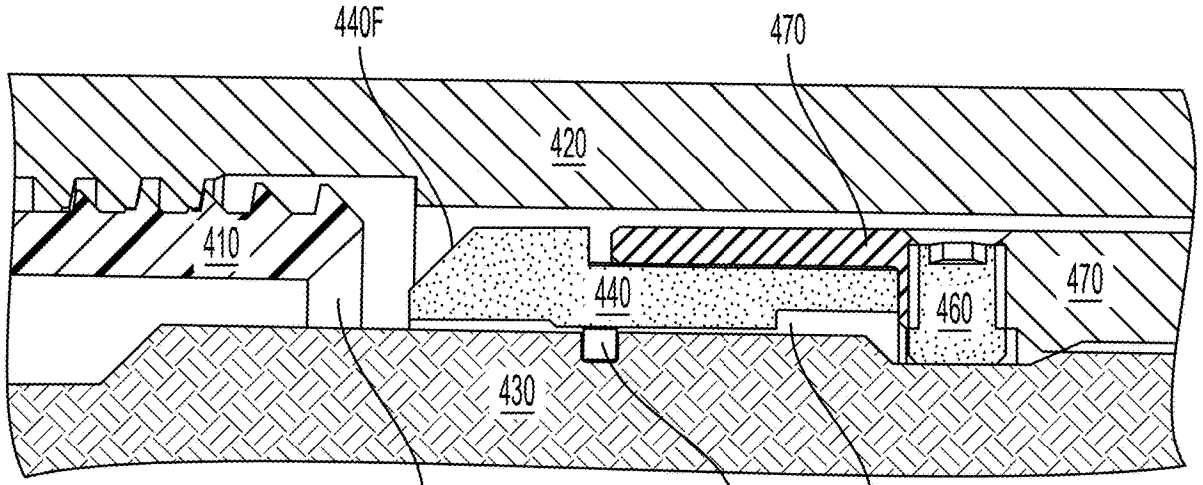

FIGS. 4A and 4B illustrate cross-sectional views of parts of a lower end of a wellbore string that attach to an upper end portion of a wellbore tool. FIG. 4A shows a threaded portion of collet finger 410 that contacts threads of a portion of wellbore tool 420. FIG. 4A also includes various parts that include mandrel 430, ring housing 440, shearable element 450, threaded mount 460, and cover 470. Here collet finger 410, mandrel 430, ring housing 440, and shear element 450 may respectively be the same as collet finger 220, mandrel 210, ring housing 226, and shear ring 228 of FIGS. 2A & 2B. Faces 410F & 440F respectively of collet finger 410 and ring housing 440 may abut each other when the wellbore string is coupled to the wellbore tool. As such a ring housing may abut a collet when the collet is in an engaged position.

FIG. 4A is representative of relative positions of parts of the lower end of a wellbore string when the wellbore string is coupled to wellbore tool 420. To decouple the wellbore string from wellbore tool 420, the release mechanism of the assembly discussed in respect to FIGS. 2A & 2B may be released such that the wellbore string may be disengaged from wellbore tool 420. The wellbore string may then be pulled out of the wellbore. In various instances, when the release mechanism is placed in a disengaged state, the wellbore tool may not decouple from the wellbore string. As discussed above, tension applied to the wellbore string may result in breakage of a shearable element (e.g., shearable element 450 of FIG. 4A). Areas 450B & 450C of FIGS. 4A and 4B may be areas where broken pieces of shearable element 450 may fall when ring housing 440 moves axially relative to mandrel 430 when shearable element 450 breaks. Areas 450B and 450C may be referred to respectively as "a first space" and "a second space" of a wellbore string. The relative motion of ring housing 440 may result in a portion of ring housing 440 being forced into areas 450B & 450C of FIGS. 4A and 4B. This relative motion may also result in faces 410F & 440F of collet finger 410 and ring housing 440 separating as illustrated in FIG. 4B.

FIG. 4B shows how ring housing 440 may move relative to mandrel 430 when shearable element 450 breaks. Note that FIG. 4B includes many of the same elements (collet finger 410, wellbore tool 420, mandrel 430, ring housing 440, threaded mount 460, and cover 470) that are included in FIG. 4A. FIG. 4B does not show shearable element 450 yet does show areas 450B and 450C where parts of a broken shearable element 450 may reside after shearable element 450 breaks. The breakage of shearable element 450 allows faces 410F & 440F of collet finger 410 and ring housing 440 to move apart. Areas 450B and 450C may be spaces into which pieces of shareable element 450 move when shearable element 450 breaks.

Failures of parts of a mechanism that couples a wellbore string to a wellbore tool may result in a coupling of that mechanism not releasing. For example, a failure of a seal or tube that provides hydraulic fluid to an actuation mechanism may result in the actuation mechanism not releasing. In instances when a coupling mechanism does not properly release, forces used to decouple a wellbore string from a wellbore tool may be transferred to shearable element 450, shearable element 450 may break, and this may result in a wellbore tool being left in a wellbore.

In instances, operators of the wellbore may wish to redeploy the wellbore string in an attempt to move or remove the wellbore tool. At this time, the operators need a maximum force to be exerted to pull the wellbore tool out of the hole. In such instances, the "shear to release" mechanism must be disabled to allow maximum tension to be applied to the wellbore tool. To address this, apparatus consistent with the present disclosure may be augmented with a device that prevents a shearable element from breaking. Such an element that may be referred to as a "shear blocking element" a "shear ring blocker," or a "shear ring blocking device,"

An apparatus of the present disclosure may include features that allow for a shear blocking element to be installed in or added to a wellbore string. This shear blocking element may be designed to fit into space 450C shown in FIGS. 4A and 4B. In such instances, the shear blocking element may have a shape that abuts at least one side of ring housing 440. To place the shear blocking element into space 450C, the wellbore string may be removed from the wellbore, a screw that holds cover 470 in place by threaded mount 460 may be removed, cover 470 may be removed, a shear blocking element may be placed into space 450C, and cover 470 may be aligned such that mount 460 (e.g., a threaded mount that may receive a screw) may be used to reattach cover 470 to mandrel 430.

Once the shear blocking element is securely contained within space 450C, it may abut both the right side of ring housing 440 and may abut a portion of cover 470. Such a placement of the shear blocking element may prevent ring housing 440 from moving to the right relative to mandrel 430. This may also prevent tension forces applied to the wellbore string from being transferred to a shear ring. A force required to break a shear blocking element may be greater than a force required to break a shear ring of a given assembly.

Figure 5A:
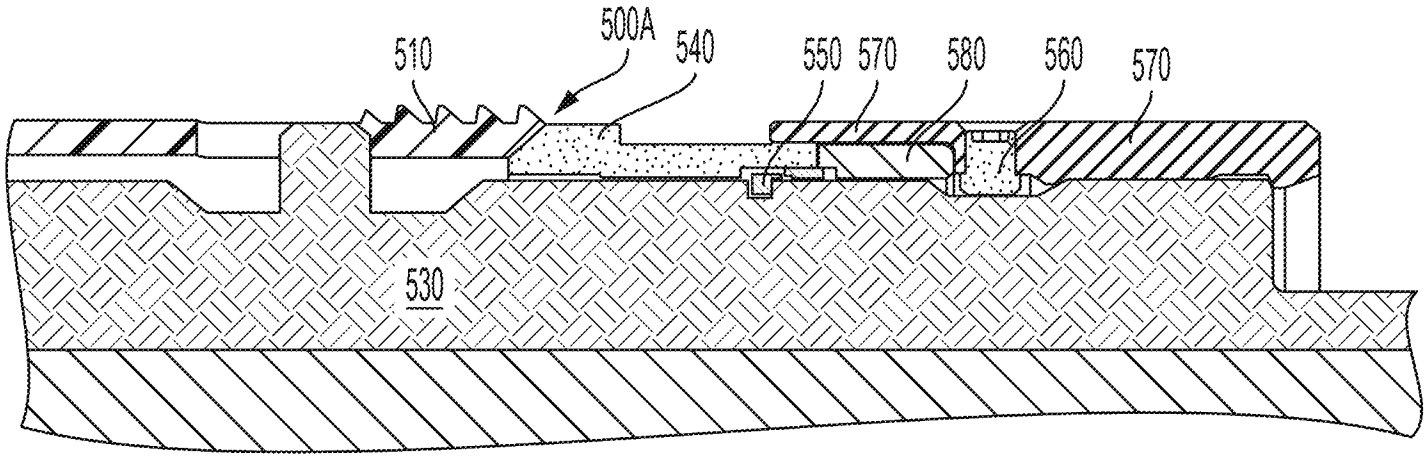
FIGS. 5A and 5B illustrate cross-sectional views of parts of a lower end of a wellbore sting that attach to an upper end portion of a wellbore tool, in accordance with aspects of the present disclosure.
Figure 5B:
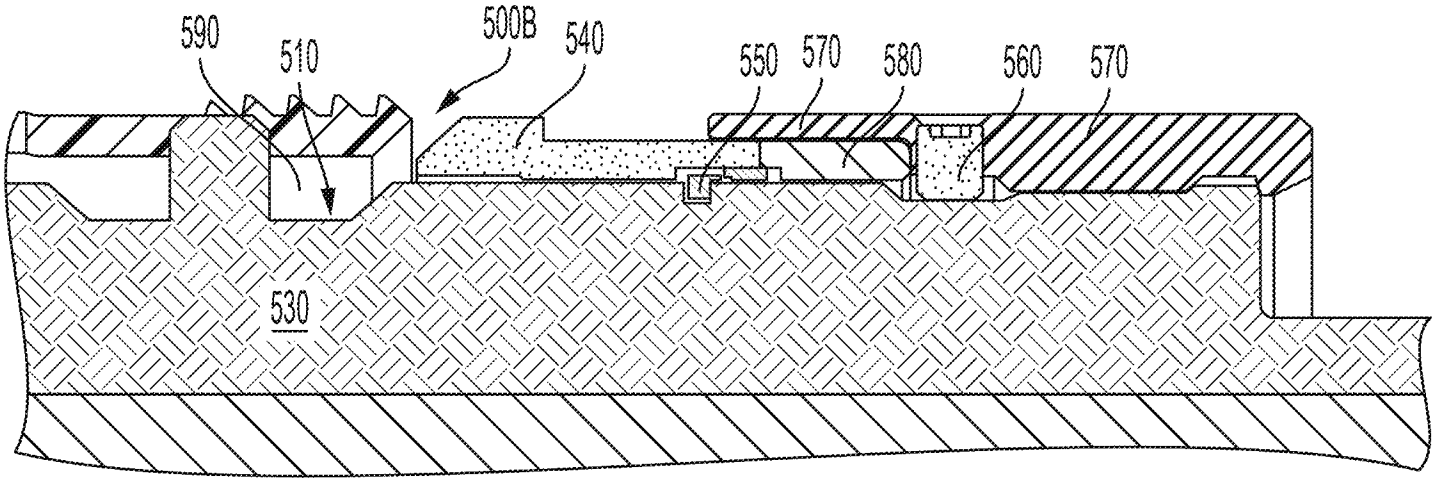

FIGS. 5A and 5B illustrate cross-sectional view of parts of a lower end of a wellbore sting that attach to an upper end portion of a wellbore tool. Like FIGS. 4A & 4B, FIGS. 5A & 5B include a collet finger (510), a mandrel (530), a ring housing (540), a shearable element (550), e.g. a shear ring, a screw mount (560), and a cover (570). FIGS. 5A & 5B also include shear blocking element 580. Note that shear blocking element 580 is located in a space between ring housing 540 and cover 570. Here instead of just being an empty space like space 450C of FIGS. 4A & 4B, shear blocking element 580 fills at least a portion of that empty space to prevent forces from being transferred to shearable element 550.

FIG. 5A shows ring housing 540 being located between collet finger 510 and shear blocking element 580. As such, FIG. 5A shows a ring housing being located between a collet and a shear blocking element. FIG. 5A also shows one side of ring housing 540 abutting both collet finger 510 and shear blocking element 580 when the collet is in engaged position 500A.

FIG. 5B includes a gap between that separates a face of collet finger 510 from a face of ring housing 540 when the collet is in disengaged position 500B. FIG. 5B shows that once collet finger is in disengaged position 500B, collet finger 510 may move downward into a space as indicated by arrow 590.

Figure 6:
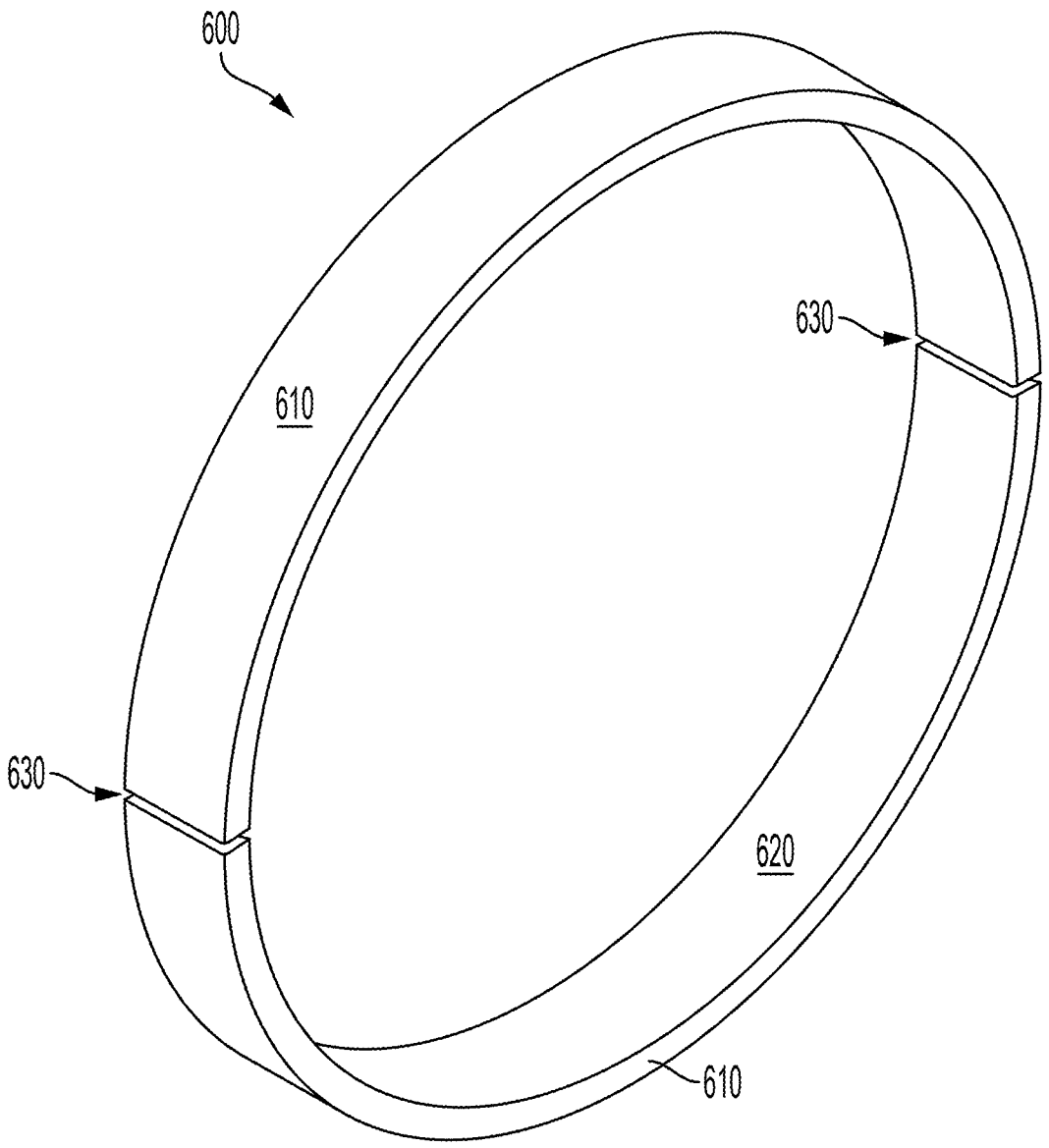
FIG. 6 illustrates a shear blocking element that has a circular shape and that is in the form of a split ring, in accordance with aspects of the present disclosure.

FIG. 6 illustrates a shear blocking element that has a circular shape and that is in the form of a split ring. Shear blocking element 600 of FIG. 6 includes a first part 610 and a second part 620 that once installed in a space like space 450C of FIGS. 4A & 4B form the shape of a ring. In certain instances, the first part 610 and the second part 620 may be separate parts that are placed into a space of a coupling mechanism one at a time. In such an instance, edges 630 of these parts may abut each other when the first part 610 and the second part 620 are placed into the space of the coupling mechanism. Making the shear blocking element 600 in the form of a split ring may allow it to be assembled easily as an accessory to an existing tool.

Apparatus or mechanisms of the present disclosure may also be configured to decouple a wellbore string from a wellbore tool using other release mechanisms. For example, a secondary release mechanism may be configured to release a tool when a wellbore string is rotated to a secondary release position.

Figure 7:
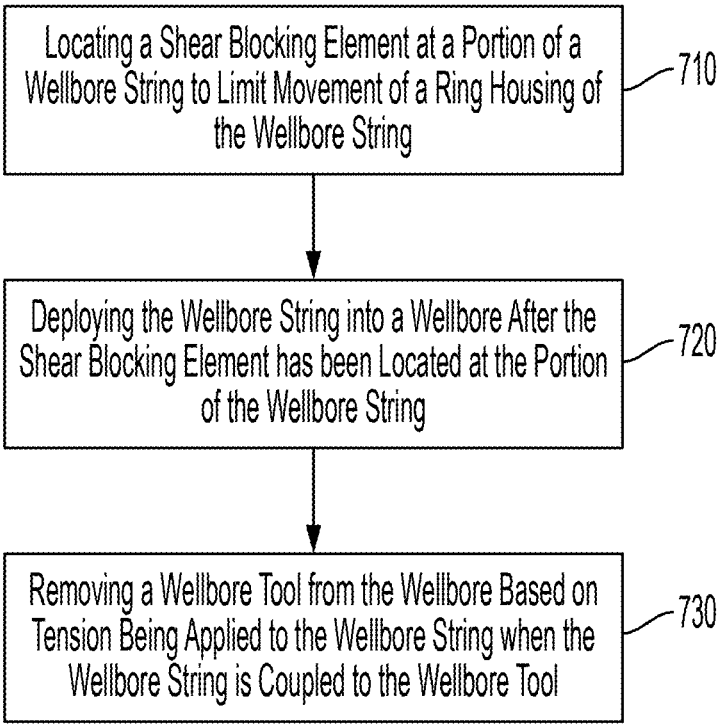
FIG. 7 illustrates actions that may be used to retrieve a wellbore tool from a wellbore.

FIG. 7 illustrates actions that may be used to retrieve a wellbore tool from a wellbore. At block 710 a shear blocking element may be located at a portion of a wellbore sting to limit movement of a ring housing of the wellbore string. As discussed in respect FIGS. 2-6 above, the shear blocking element may be placed in a space of the wellbore string after a shearable element of the wellbore string has been broken.

Alternatively, the shear blocking element may be placed in the space when a shearable element is located within another space of the wellbore string. In such an instance, the wellbore string may prevent the shearable element from receiving forces that would otherwise break the shearable element.

At block 720, the wellbore string may be deployed in a wellbore when the shearable element is located in the space of the wellbore string. The deployment of the wellbore string at block 720 may result in the wellbore string being coupled to a tool, tubular, or other assembly (a wellbore tool) that is located in the wellbore.

At block 730 the wellbore tool may be removed from the wellbore based on tension being applied to the wellbore string when the wellbore string is coupled to the wellbore tool.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Aspects of the disclosure include:

Aspect 1: A mechanism comprising a collet that couples a wellbore string to a wellbore tool when the collet is in an engaged position; a ring housing that abuts the collet when the collet is in the engaged position; a first space of the mechanism that is adjacent to the ring housing; and a shear blocking element configured to be located in a second space of the mechanism, wherein the shear blocking element when located in the second space of the mechanism limits movement of the ring housing toward the first space of the mechanism.

Aspect 2: The mechanism of Aspect 1, wherein the ring housing is movable along a direction parallel to a center line of the wellbore sting when the collet is in a disengaged position, and the ring housing is restrained from moving along the direction parallel to the center line of the wellbore string when the collet is in the engaged position based on the ring housing being located between the collet and the shear blocking element.

Aspect 3: The mechanism of Aspect 1 or 2, wherein the first space is configured to receive a shearable element, the shearable element directly engages with the ring housing when the shearable element is located in the first space of the mechanism; and the shearable element is configured to break when a first force is transferred to the shearable element.

Aspect 4: The mechanism of any of Aspects 1 through 3, wherein the first force is transferred to a/the shearable element based on the shear blocking element not being located in the second space of the mechanism when tension is applied to the wellbore string.

Aspect 5: The mechanism of Aspect 4, wherein the shear blocking element is configured to break at a second force.

Aspect 6: The mechanism Aspect 5, wherein the second force is greater than the first force.

Aspect 7: The mechanism of any of Aspects 1 through 6, further comprising a cover that covers a portion of the second space; and a threaded mount that receives a screw that holds the cover in place, wherein the cover retains the shear blocking element in the second space based on the screw holding the cover in place.

Aspect 8: The mechanism of any of Aspects 1 through 7, further comprising a mandrel that receives the collet, wherein the screw attaches the cover to the mandrel based on the screw being received by a/the threaded mount.

Aspect 9: The mechanism of any of Aspects 1 through 8, wherein the shear blocking element has a circular shape.

Aspect 10: The mechanism of any of Aspects 1 through 9, wherein the shear blocking element is a split ring.

Aspect 11: A method for retrieving a wellbore tool from a wellbore, the method comprising locating a shear blocking element in a second space of a wellbore string to limit movement of a ring housing of the wellbore string toward a first space of the wellbore string; deploying the wellbore string into the wellbore to attach the wellbore string to a wellbore tool based on the wellbore string including a collet, the ring housing, and the shear blocking element; and removing the wellbore tool from the wellbore based on tension being applied to the wellbore string, wherein the shear blocking element limits the movement of the ring housing toward the first space of the wellbore string based on the ring housing being located between the collet and the shear blocking element.

Aspect 12: The method of Aspect 11, further comprising removing the wellbore string from the wellbore when a shearable element of the wellbore string is broken, wherein the breaking of the shearable element results in the wellbore tool being disconnected from the wellbore string.

Aspect 13: The method of Aspect 11 or 12, wherein the ring housing is movable along a direction parallel to a center line of the wellbore sting when the collet is in a disengaged position, and the ring housing is restrained from moving along the direction parallel to the center line of the wellbore string when the collet is in an engaged position based on the ring housing being located between the collet and the shear blocking element.

Aspect 14: The method of any of Aspects 11 through 13, wherein the first space is configured to receive a shearable element, the shearable element directly engages with the ring housing when the shearable element is located in the first space of the wellbore string, and the shearable element is configured to break when a first force is transferred to the shearable element.

Aspect 15: The method of Aspect 14, wherein the shear blocking element is configured to break at a second force.

Aspect 16: The method of Aspect 15, wherein the second force is greater than the first force.

Aspect 17: The method of any of Aspects 11 through 15, further comprising covering a portion of the second space with a cover; and attaching a retention mechanism that retains the shear blocking element in the second space based on the retention mechanism holding the cover in place.

Aspect 18: The method of any of Aspects 11 through 17, wherein a/the mandrel receives the collet, and the retention mechanism is a screw that attaches the cover to the mandrel based on the screw being received by a threaded mount.

Aspect 19: The method of any of Aspects 11 through 18, wherein the shear blocking element has a circular shape.

Aspect 20: The method of any of Aspects 11 through 19, wherein the shear blocking element is a split ring.

What is claimed is:

1. A mechanism comprising:

a collet that couples a wellbore string to a wellbore tool when the collet is in an engaged position;

a ring housing that abuts the collet when the collet is in the engaged position, wherein the ring housing is configured to move axially;

a first space of the mechanism that is adjacent to the ring housing, wherein the first space contains a shearable element;

a shear blocking element configured to be located in a second space of the mechanism:

wherein the shear blocking element when located in the second space of the mechanism limits movement of the ring housing toward the first space of the mechanism and bypasses a tensile force from the shearable element to the shear blocking element to maintain the coupling of the wellbore string to the wellbore tool;

wherein the shear blocking element is removably coupled to the mechanism; and wherein the tensile force from the ring housing is exposed to the shearable element prior to being redirected by the shear blocking element; and a cover coupled to a mandrel, wherein the mandrel receives the collet, and wherein the cover covers a portion of the second space and retains the shear blocking element in the second space.

2. The mechanism of claim 1, wherein:

the ring housing is movable along a direction parallel to a center line of the wellbore sting when the collet is in a disengaged position, and the ring housing is restrained from moving along the direction parallel to the center line of the wellbore string when the collet is in the engaged position based on the ring housing being located between the collet and the shear blocking element.

3. The mechanism of claim 1, wherein:

the shearable element directly engages with the ring housing when the shearable element is located in the first space of the mechanism; and the shearable element is configured to break when a first force is transferred to the shearable element.

4. The mechanism of claim 3, wherein the first force is transferred to the shearable element based on the shear blocking element not being located in the second space of the mechanism when tension is applied to the wellbore string.

5. The mechanism of claim 3, wherein the shear blocking element is configured to break at a second force.

6. The mechanism of claim 1, wherein the second force is greater than the first force.

7. The mechanism of claim 1, further comprising:

a threaded mount that receives a screw that holds the cover in place, wherein the cover retains the shear blocking element in the second space based on the screw holding the cover in place.

8. The mechanism of claim 7, wherein the screw attaches the cover to the mandrel based on the screw being received by the threaded mount.

9. The mechanism of claim 1, wherein the shear blocking element has a circular shape.

10. The mechanism of claim 1, wherein the shear blocking element is a split ring.

11. A method for retrieving a wellbore tool from a wellbore, the method comprising:

locating a shear blocking element in a second space of a wellbore string to limit movement of a ring housing of the wellbore string toward a first space of the wellbore string and bypass a tensile force from a shearable element to the shear blocking element to maintain a coupling of the wellbore string to the wellbore tool:

wherein the first space contains the shearable element;

wherein the shear blocking element is removably coupled to the wellbore string; and wherein the tensile force from the ring housing is exposed to the shearable element prior to being redirected by the shear blocking element;

covering a portion of the second space with a cover, wherein the cover retains the shear blocking element in the second space;

deploying the wellbore string into the wellbore to attach the wellbore string to a wellbore tool based on the wellbore string, including a collet received by a mandrel of the wellbore string, the ring housing, and the shear blocking element; and removing the wellbore tool from the wellbore based on tension being applied to the wellbore string, wherein the shear blocking element limits the movement of the ring housing toward the first space of the wellbore string based on the ring housing being located between the collet and the shear blocking element.

12. The method of claim 11, further comprising:

removing the wellbore string from the wellbore when a shearable element of the wellbore string is broken, wherein the breaking of the shearable element results in the wellbore tool being disconnected from the wellbore string.

13. The method of claim 11, wherein:

the ring housing is movable along a direction parallel to a center line of the wellbore sting when the collet is in a disengaged position, and the ring housing is restrained from moving along the direction parallel to the center line of the wellbore string when the collet is in an engaged position based on the ring housing being located between the collet and the shear blocking element.

14. The method of claim 11, wherein:

the shearable element directly engages with the ring housing when the shearable element is located in the first space of the wellbore string; and the shearable element is configured to break when a first force is transferred to the shearable element.

15. The method of claim 14, wherein the shear blocking element is configured to break at a second force.

16. The method of claim 11, wherein the second force is greater than the first force.

17. The method of claim 11, further comprising:

attaching a retention mechanism that retains the shear blocking element in the second space based on the retention mechanism holding the cover in place.

18. The method of claim 17, wherein the retention mechanism is a screw that attaches the cover to the mandrel based on the screw being received by a threaded mount.

19. The method of claim 11, wherein the shear blocking element has a circular shape.

20. The method of claim 11, wherein the shear blocking element is a split ring.

* * * * *